US007517056B2

(12) United States Patent
Fellner et al.

(10) Patent No.: US 7,517,056 B2
(45) Date of Patent: Apr. 14, 2009

(54) FLUID EJECTION DEVICE

(75) Inventors: Elizabeth A. Fellner, San Diego, CA (US); James Pingel, San Diego, CA (US); Matthew David Giere, San Diego, CA (US); Satya Prakash, San Diego, CA (US); David W Jenkins, San Diego, CA (US); James A Feinn, San Diego, CA (US); Arun K Agarwal, Corvallis, OR (US); Julie J Cox, Corvallis, OR (US); Jules G Moritz, Corvallis, OR (US); Ozgur Yildirim, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 343 days.

(21) Appl. No.: 11/352,678

(22) Filed: Feb. 13, 2006

(65) Prior Publication Data

US 2006/0268071 A1 Nov. 30, 2006

Related U.S. Application Data

(63) Continuation-in-part of application No. 11/140,802, filed on May 31, 2005, now Pat. No. 7,431,434.

(51) Int. Cl.
*B41J 2/05* (2006.01)

(52) U.S. Cl. ..... 347/56; 347/65

(58) Field of Classification Search ..... 347/20, 347/56, 61–65, 67, 92–94
See application file for complete search history.

(56) References Cited

U.S. PATENT DOCUMENTS

| | | | | |
|---|---|---|---|---|
| 4,882,595 | A | 11/1989 | Trueba et al. | 347/85 |
| 4,967,208 | A | 10/1990 | Childers | 347/56 |
| 5,124,716 | A | 6/1992 | Roy et al. | 324/530 |
| 5,519,423 | A | 5/1996 | Moritz, III et al. | 347/65 |
| 5,898,448 | A | 4/1999 | Ishikawa | 347/69 |
| 5,912,685 | A | 6/1999 | Raman | 347/65 |
| 5,946,012 | A | 8/1999 | Courian et al. | 347/63 |
| 6,042,222 | A | 3/2000 | Moritz, III et al. | 347/65 |
| 6,158,846 | A | 12/2000 | Kawamura | 347/65 |
| 6,193,347 | B1 * | 2/2001 | Askeland et al. | 347/15 |
| 6,247,798 | B1 | 6/2001 | Cleland et al. | 347/65 |
| 6,259,463 | B1 | 7/2001 | Askeland et al. | 347/15 |
| 6,309,052 | B1 | 10/2001 | Prasad et al. | 347/57 |
| 6,409,318 | B1 | 6/2002 | Clark | 347/65 |
| 6,443,564 | B1 | 9/2002 | Keil et al. | 347/65 |
| 6,447,104 | B1 * | 9/2002 | Keil et al. | 347/65 |
| 6,467,882 | B2 | 10/2002 | Inui et al. | 347/56 |
| 6,489,084 | B1 | 12/2002 | Pidwerbecki et al. | 347/65 |
| 6,491,377 | B1 | 12/2002 | Cleland et al. | 347/58 |

(Continued)

FOREIGN PATENT DOCUMENTS

| | | |
|---|---|---|
| EP | 0705695 | 4/1996 |

*Primary Examiner*—Juanita D Stephens

(57) ABSTRACT

A fluid ejection device includes a fluid chamber, a fluid restriction communicated with the fluid chamber, and a fluid channel communicated with the fluid restriction. The fluid restriction has a fluid restriction parameter defined as (2*W+2*H)*L/(H*W), wherein W is a width of the fluid restriction, H is a height of the fluid restriction, and L is a length of the fluid restriction. As such, the fluid restriction parameter is in a range of 1.5 to 5.75.

20 Claims, 5 Drawing Sheets

U.S. PATENT DOCUMENTS

| | | | | |
|---|---|---|---|---|
| 6,502,915 | B1 | 1/2003 | Feinn et al. | 347/12 |
| 6,536,878 | B2 | 3/2003 | Kasperchik et al. | 347/65 |
| 6,561,632 | B2 | 5/2003 | Feinn et al. | 347/65 |
| 6,565,195 | B2 | 5/2003 | Blair | 347/65 |
| 6,719,405 | B1 * | 4/2004 | Powers | 347/62 |
| 6,729,715 | B2 | 5/2004 | Gonzalez | 347/65 |
| 2003/0202046 | A1 | 10/2003 | Abdelli et al. | 347/47 |

* cited by examiner

| ORIFICE LAYER THICKNESS | 20 +/- 1 um | | | | |
|---|---|---|---|---|---|
| **INK PROPERTIES** | **INK #1** | **INK #2** | **INK #3** | **INK #4** | **RANGE** |
| INK VISCOSITY (cP) | 2.5 | 1.8-3.2 | 2.6-3.8 | 2.3 | 1.5-4.0 |
| INK SURFACE TENSION (dynes/cm) | 33 | 25.3-27 | 22.1-24 | 25.4 | 21-35 |
| **SYSTEM PERFORMANCE** | **INK #1** | **INK #2** | **INK #3** | **INK #4** | **RANGE** |
| DROP WEIGHT (ng) | 9.6 | 7.9 | 6.1 | 6.5 | 5.5-10.5 |
| DROP VELOCITY (m/s) | 10.8 | 11.4 | 12.6 | 11.3 | 10 -14 |
| FREQUENCY RANGE (kHz) | 0-48 | 0-36 | 0-48 | 0-48 | 0-48 |
| **DESIGN PARAMETERS** | **INK #1** | **INK #2** | **INK #3** | **INK #4** | **RANGE** |
| RESISTOR AREA ($um^2$) | 575 | 462 | 360 | 360 | 325-625 |
| RESISTOR SIZE (um) | 24 | 21.5 | 19 | 19 | 18-25 |
| ORIFICE DIAMETER, d (um) | 17.2 | 17.2 | 15 | 15 | 14-18.5 |
| SHELF LENGTH, D (um) | 47.2-56.8 | 47.2-56.9 | 47.2-56.10 | 47.2-56.11 | 45-58 |
| FLUID RESTRICTION PARAMETER =(2*W+2*H)*L/(H*W) | 1.71 | 1.71 | 3.06 | 5.51 | 1.5 -5.75 |

*Fig. 7*

| ORIFICE LAYER THICKNESS | 14 +/- 1 um | | | | |
|---|---|---|---|---|---|
| **INK PROPERTIES** | **INK #1** | **INK #2** | **INK #3** | **INK #4** | **RANGE** |
| INK VISCOSITY (cP) | 2.8 | 2.9-3.2 | 2.7 | 1.9-2.4 | 1.5-3.5 |
| INK SURFACE TENSION (dynes/cm) | 24 | 23.9-25.3 | 21.7 | 21.4-29.1 | 21-30 |
| **SYSTEM PERFORMANCE** | **INK #1** | **INK #2** | **INK #3** | **INK #4** | **RANGE** |
| DROP WEIGHT (ng) | 6.5 | 6.2 | 5.5 | 4.2 | 3.5-7.5 |
| DROP VELOCITY (m/s) | 11.5 | 12.2 | 10 | 13.6 | 8-15.5 |
| FREQUENCY RANGE (kHz) | 0-48 | 0-36 | 0-36 | 0-48 | 0-48 |
| **DESIGN PARAMETERS** | **INK #1** | **INK #2** | **INK #3** | **INK #4** | **RANGE** |
| RESISTOR AREA ($um^2$) | 420 | 393 | 350 | 260 | 200-475 |
| RESISTOR SIZE (um) | 20.5 | 19.8 | 18.7 | 16.1 | 14-22 |
| ORIFICE DIAMETER, d (um) | 16.4 | 16 | 16 | 13 | 12-17.5 |
| SHELF LENGTH, D (um) | 47.2-56.8 | 47.2-56.8 | 47.2-56.8 | 47.2-56.8 | 45-58 |
| FLUID RESTRICTION PARAMETER =(2*W+2*H)*L/(H*W) | 1.66 | 1.66 | 4.29 | 3.93 | 1.5 -4.5 |

*Fig. 8*

FLUID EJECTION DEVICE

CROSS-REFERENCE TO RELATED APPLICATIONS

This application is a Continuation-In-Part of U.S. patent application Ser. No. 11/140,802, filed on May 31, 2005, now U.S. Pat. No. 7,431,434 assigned to the Assignee of the present invention, and incorporated herein by reference.

BACKGROUND

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

In one arrangement, the printhead may accommodate different color inks, such as black ink and/or one or more colored inks. The different color inks, however, may have different properties and, therefore, different performance characteristics. Accordingly, to optimize performance of the printhead, it is desirable to select or tune parameters of the printhead to accommodate one or more different inks.

SUMMARY

One aspect of the present invention provides a fluid ejection device. The fluid ejection device includes a fluid chamber, a fluid restriction communicated with the fluid chamber, and a fluid channel communicated with the fluid restriction. The fluid restriction has a fluid restriction parameter defined as (2*W+2*H)*L/(H*W), wherein W is a width of the fluid restriction, H is a height of the fluid restriction, and L is a length of the fluid restriction. As such, the fluid restriction parameter is in a range of 1.5 to 5.75.

BRIEF DESCRIPTION OF THE DRAWINGS

FIG. 7 is a table outlining one embodiment of exemplary parameters and exemplary ranges of parameters of a fluid ejection device according to the present invention.

FIG. 8 is a table outlining another embodiment of exemplary parameters and exemplary ranges of parameters of a fluid ejection device according to the present invention.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
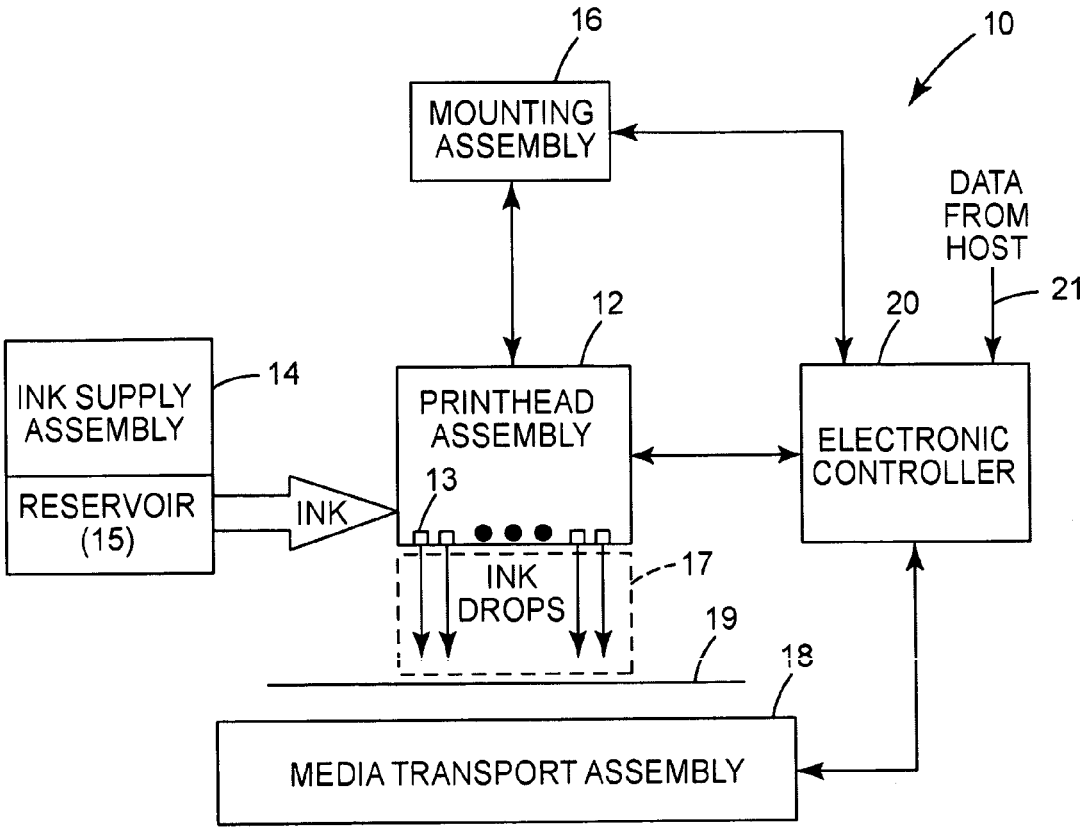
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection device, such as a printhead assembly 12, and a fluid supply, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection device, is formed according to an embodiment of the present invention and ejects drops of ink, including one or more colored inks, through a plurality of orifices or nozzles 13. While the following description refers to the ejection of ink from printhead assembly 12, it is understood that other liquids, fluids, or flowable materials may be ejected from printhead assembly 12.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and print media 19 are moved relative to each other.

Print media 19 includes, for example, paper, card stock, envelopes, labels, transparent film, cardboard, rigid panels, and the like. In one embodiment, print media 19 is a continuous form or continuous web print media 19. As such, print media 19 may include a continuous roll of unprinted paper.

Ink supply assembly 14, as one embodiment of a fluid supply, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet or fluidjet cartridge or pen. In another embodiment, ink supply assembly 14 is separate from printhead assembly 12 and supplies ink to printhead assembly through an interface connection, such as a supply tube (not shown).

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. Print media 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry forming a portion of electronic controller 20 is located off printhead assembly 12.

Figure 2:
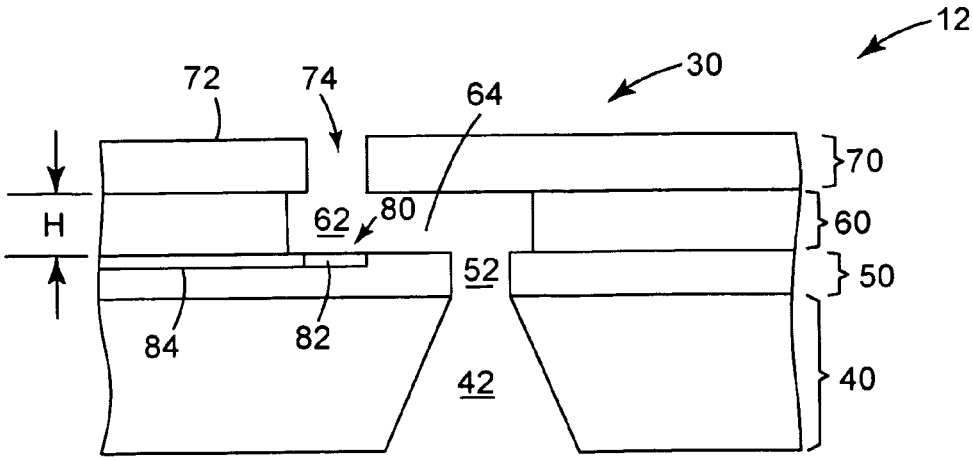
FIG. 2 is a schematic cross-sectional view illustrating one embodiment of a portion of a fluid ejection device according to the present invention.

FIG. 2 illustrates one embodiment of a portion of printhead assembly 12. Printhead assembly 12, as one embodiment of a fluid ejection device, includes an array of drop ejecting elements 30. Drop ejecting elements 30 are formed on a substrate 40 which has a fluid (or ink) feed slot 42 formed therein. As such, fluid feed slot 42 provides a supply of fluid (or ink) to drop ejecting elements 30.

In one embodiment, each drop ejecting element 30 includes a thin-film structure 50, a barrier layer 60, an orifice layer 70, and a drop generator 80. Thin-film structure 50 has a fluid (or ink) feed opening 52 formed therein which communicates with fluid feed slot 42 of substrate 40 and barrier layer 60 has a fluid ejection chamber 62 and one or more fluid channels 64 formed therein such that fluid ejection chamber 62 communicates with fluid feed opening 52 via fluid channels 64.

Orifice layer 70 has a front face 72 and an orifice or nozzle opening 74 formed in front face 72. Orifice layer 70 is extended over barrier layer 60 such that nozzle opening 74 communicates with fluid ejection chamber 62. In one embodiment, drop generator 80 includes a resistor 82. Resistor 82 is positioned within fluid ejection chamber 62 and is electrically coupled by leads 84 to drive signal(s) and ground.

While barrier layer 60 and orifice layer 70 are illustrated as separate layers, in other embodiments, barrier layer 60 and orifice layer 70 may be formed as a single layer of material with fluid ejection chamber 62, fluid channels 64, and/or nozzle opening 74 formed in the single layer. In addition, in one embodiment, portions of fluid ejection chamber 62, fluid channels 64, and/or nozzle opening 74 may be shared between or formed in both barrier layer 60 and orifice layer 70.

In one embodiment, during operation, fluid flows from fluid feed slot 42 to fluid ejection chamber 62 via fluid feed opening 52 and one or more fluid channels 64. Nozzle opening 74 is operatively associated with resistor 82 such that droplets of fluid are ejected from fluid ejection chamber 62 through nozzle opening 74 (e.g., substantially normal to the plane of resistor 82) and toward a print medium upon energization of resistor 82.

In one embodiment, printhead assembly 12 is a fully integrated thermal inkjet printhead. As such, substrate 40 is formed, for example, of silicon, glass, or a stable polymer, and thin-film structure 50 includes one or more passivation or insulation layers formed, for example, of silicon dioxide, silicon carbide, silicon nitride, tantalum, poly-silicon glass, or other material. Thin-film structure 50 also includes a conductive layer which defines resistor 82 and leads 84. The conductive layer is formed, for example, by aluminum, gold, tantalum, tantalum-aluminum, or other metal or metal alloy. In addition, barrier layer 60 is formed of one or more layers of material including, for example, a photoimageable epoxy resin, such as SU8, and orifice layer 70 is formed of one or more layers of material including, for example, a photopolymer, such as SU8, or a metallic material, such as nickel, copper, iron/nickel alloys, palladium, gold, or rhodium. Other materials, however, may be used for barrier layer 60 and/or orifice layer 70.

Figure 3:
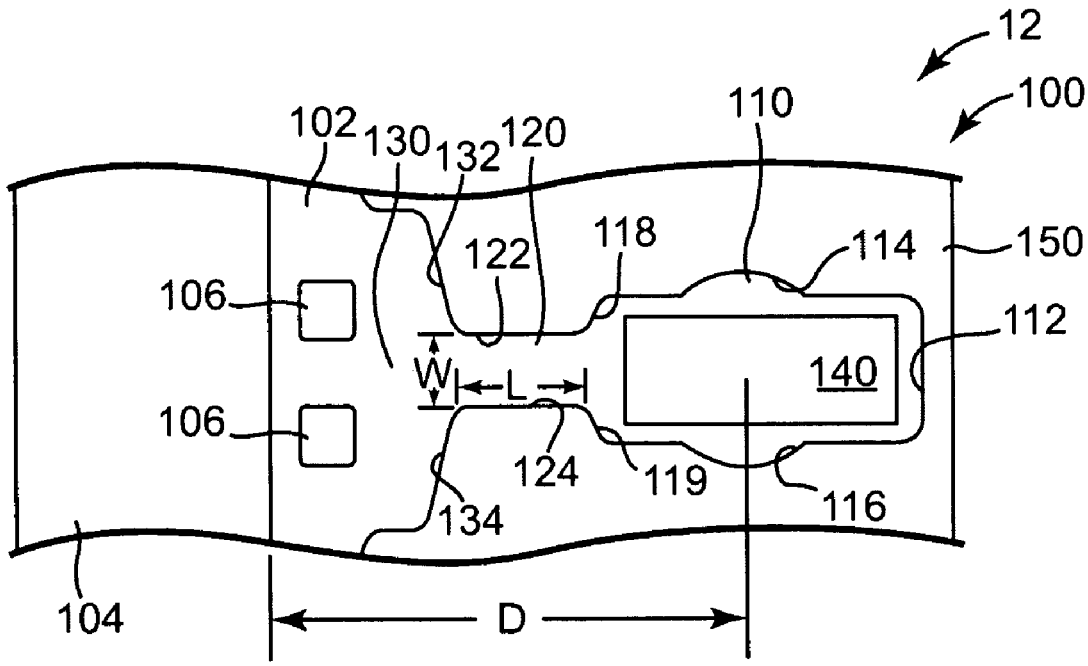
FIG. 3 is a plan view illustrating one embodiment of a portion of a fluid ejection device according to the present invention.

FIG. 3 illustrates one embodiment of a portion of a fluid ejection device with the orifice layer removed. Fluid ejection device 100 includes a fluid ejection chamber 110, a fluid restriction 120, and a fluid channel 130. In one embodiment, fluid ejection chamber 110 includes an end wall 112, opposite sidewalls 114 and 116, and end walls 118 and 119. As such, boundaries of fluid ejection chamber 110 are defined generally by end wall 112, opposite sidewalls 114 and 116, and end walls 118 and 119. In one embodiment, sidewalls 114 and 116 are contoured to follow a profile of an orifice communicated with fluid ejection chamber 110, as described below.

In one embodiment, fluid restriction 120 communicates with and is provided in a fluid flow path between fluid channel 130 and fluid ejection chamber 110. Parameters of fluid restriction 120 and fluid channel 130 are defined to optimize operation or performance of fluid ejection device 100, as described below.

In one embodiment, fluid restriction 120 includes sidewalls 122 and 124, and fluid channel 130 includes sidewalls 132 and 134. In one embodiment, sidewalls 122 and 124 are substantially linear and oriented substantially parallel with each other. In addition, sidewalls 122 and 124 are each oriented substantially perpendicular to fluid ejection chamber 110 and, more specifically, end wall 112 of fluid ejection chamber 110. In addition, in one embodiment, sidewalls 132 and 134 of fluid channel 130 are substantially linear and are each oriented at an angle to fluid restriction 120 and, more specifically, sidewalls 122 and 124 of fluid restriction 120.

In one embodiment, fluid channel 130 communicates with a supply of fluid via a fluid feed slot 104 (only one edge of which is shown in the figures) formed in a substrate 102 of fluid ejection device 100. As described above, fluid channel 130 communicates with fluid restriction 120 and, as such, supplies fluid from fluid feed slot 104 to fluid ejection chamber 110 via fluid restriction 120.

In one embodiment, one or more islands 106 are formed on substrate 102 of fluid ejection device 100 within fluid channel 130. Islands 106 provide a particle tolerant architecture which helps to prevent particles which may be present in the fluid from entering fluid channel 130 and, therefore, fluid restriction 120 and fluid ejection chamber 110.

In one embodiment, a resistor 140, as one embodiment of a drop generator, is communicated with fluid ejection chamber 110 such that droplets of fluid are ejected from fluid ejection chamber 110 by activation of resistor 140, as described above with reference to resistor 82 and FIG. 2. As such, the boundaries of fluid ejection chamber 110 are defined to encompass or surround resistor 140. In one embodiment, resistor 140 includes a single resistor. It is, however, within the scope of the present invention for resistor 140 to include a split resistor or multiple resistors.

Figure 4:
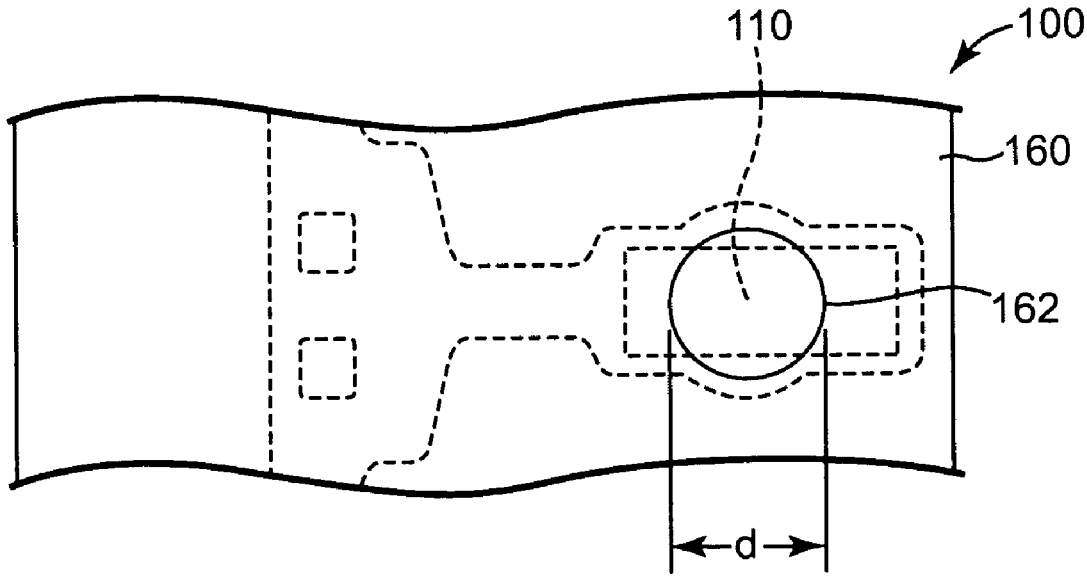
FIG. 4 is a plan view illustrating one embodiment of including an orifice layer with the fluid ejection device of FIG. 3.

In one embodiment, as illustrated in FIG. 3, fluid ejection chamber 110, fluid restriction 120, and fluid channel 130 of fluid ejection device 100 are defined in a barrier layer 150 as formed on substrate 102. In addition, in one embodiment, as illustrated in FIG. 4, an orifice layer 160 having an orifice 162 formed therein is provided over barrier layer 150 of fluid ejection device 100. Accordingly, orifice 162 communicates with fluid ejection chamber 110 such that fluid ejected from fluid ejection chamber 110 is expelled through orifice 162.

In one embodiment, a contour of fluid ejection chamber 110 follows a profile of orifice 162. For example, sidewalls 114 and 116 of fluid ejection chamber 110 are contoured to follow the profile of orifice 162. As such, in one embodiment, sidewalls 114 and 116 of fluid ejection chamber 110 each include an arcuate portion having a radius of curvature greater than that of orifice 162. In one exemplary embodiment, the radius of curvature of the arcuate portions or "cheeks" of fluid ejection chamber 110 is equal to a radius of orifice 162 plus three microns.

Figure 5:
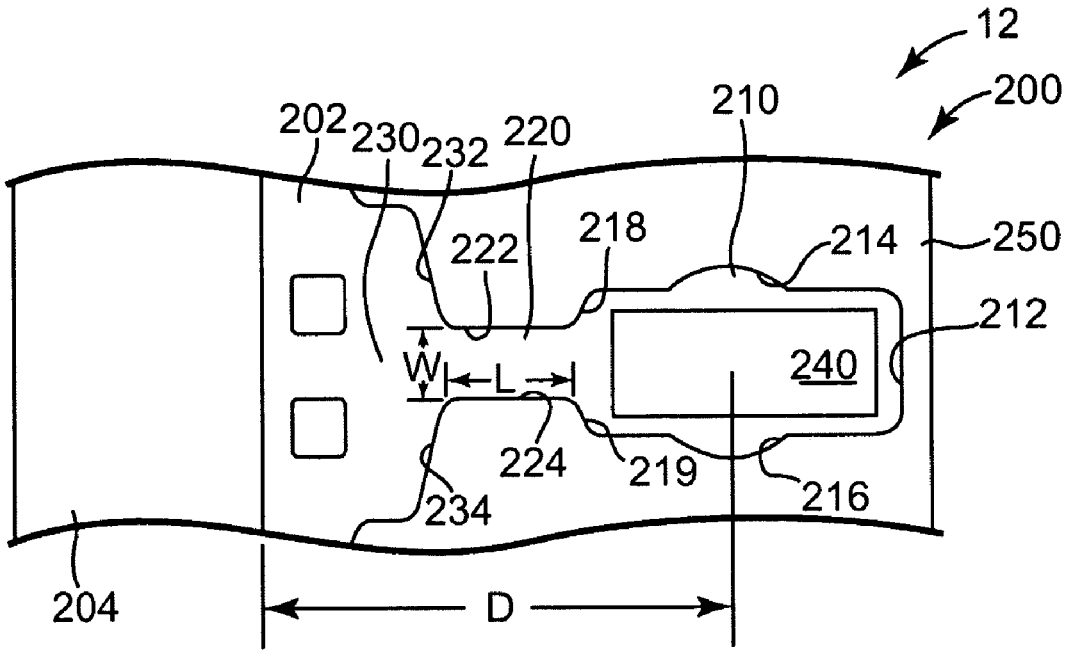
FIG. 5 is a plan view illustrating another embodiment of a portion of a fluid ejection device according to the present invention.

FIG. 5 illustrates another embodiment of a portion of a fluid ejection device with the orifice layer removed. Fluid ejection device 200, similar to fluid ejection device 100, includes a fluid ejection chamber 210, a fluid restriction 220, and a fluid channel 230. In one embodiment, fluid ejection chamber 210 includes an end wall 212, sidewalls 214 and 216, and end walls 218 and 219 arranged in a manner similar to that of fluid ejection chamber 110.

In one embodiment, fluid restriction 220 communicates with and is provided in a fluid flow path between fluid ejection chamber 210 and fluid channel 230. Similar to fluid restriction 120 and fluid channel 130 of fluid ejection device 100, parameters of fluid restriction 220 and fluid channel 230 are defined to optimize operation or performance of fluid ejection device 200, as described below. In one embodiment, fluid restriction 220 and fluid channel 230 include respective sidewalls 222 and 224, and sidewalls 232 and 234 arranged in a manner similar to that of fluid ejection device 100.

In one embodiment, fluid channel 230 communicates with a supply of fluid via a fluid feed slot 204 (only one edge of which is shown in the figures) formed in a substrate 202 of fluid ejection device 200. In addition, similar to that described above, a resistor 240, as one embodiment of a drop generator, is communicated with fluid ejection chamber 210 such that droplets of fluid are ejected from fluid ejection chamber 210 by activation of resistor 240.

Figure 6:
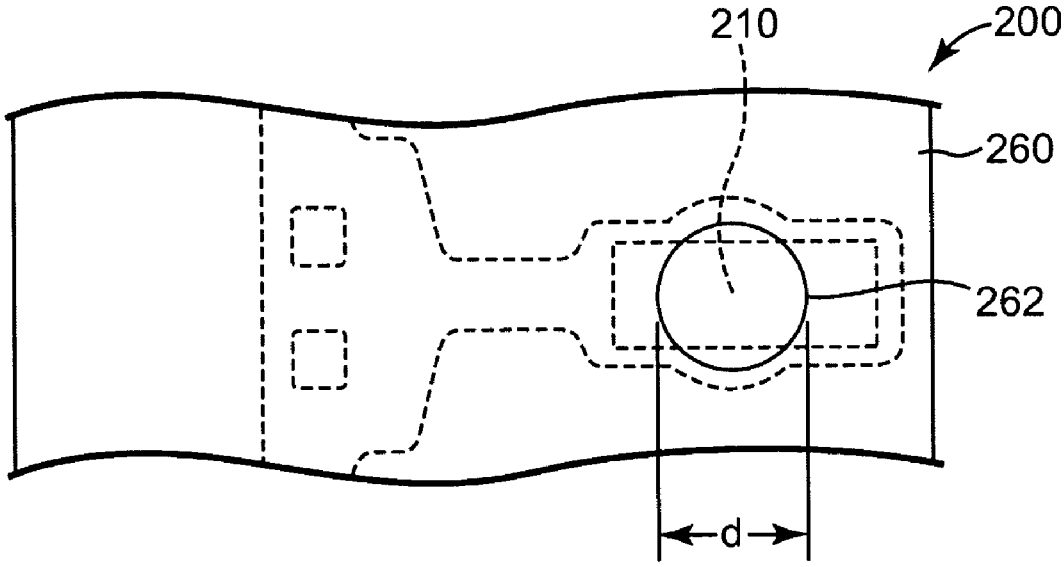
FIG. 6 is a plan view illustrating one embodiment of including an orifice layer with the fluid ejection device of FIG. 5.

As illustrated in the embodiment of FIG. 5, and similar to that described above with reference to fluid ejection device 100, fluid ejection chamber 210, fluid restriction 220, and fluid channel 230 of fluid ejection device 200 are defined in a barrier layer 250 as formed on substrate 202. In addition, as illustrated in the embodiment of FIG. 6, an orifice layer 260 having an orifice 262 formed therein is provided over barrier layer 250 of fluid ejection device 200. Accordingly, orifice 262 communicates with fluid ejection chamber 210 such that fluid ejected from fluid ejection chamber 210 is expelled through orifice 262.

In one embodiment, a plurality of fluid ejection devices 100 and/or 200 are formed on a common substrate and are arranged to substantially form one or more columns of drop ejecting elements. As such, drop ejecting elements of respective fluid ejection devices 100 and/or 200 may be used for ejecting different color inks from printhead 12. In one exemplary embodiment, fluid ejection device 100 is optimized for use with black ink and fluid ejection device 200 is optimized for use with a colored ink, as described below.

In one embodiment, as illustrated in FIGS. 3-6 and as outlined in the tables of FIGS. 7 and 8, various parameters of fluid ejection device 100 and fluid ejection device 200 are selected to optimize or improve performance of fluid ejection device 100 and fluid ejection device 200. In one embodiment, for example, a width W and a length L of fluid restrictions 120 and 220 are optimized. In addition, a shelf length or distance D from an edge of fluid feed slots 104 and 204 to a center of respective fluid ejection chambers 110 and 210 is optimized. Furthermore, an area of resistors 140 and 240, and a diameter d of orifices 162 and 262 are also optimized.

In one exemplary embodiment, as illustrated in the tables of FIGS. 7 and 8, parameters of fluid ejection device 100 and fluid ejection device 200 are optimized with a thickness of respective orifice layers 160 and 260 being generally fixed. For example, parameters of fluid restrictions 120 and 220 such as width W, length L, and a height H of fluid restrictions 120 and 220, as described below, are optimized to optimize or improve performance of fluid ejection device 100 and fluid ejection device 200.

In one embodiment, width W of fluid restrictions 120 and 220 is substantially constant and is measured between respective sidewalls 122 and 124 and sidewalls 222 and 224. In addition, length L of fluid restrictions 120 and 220 is measured along respective sidewalls 122 and 124 and sidewalls 222 and 224 between sidewalls 132 and 134 and sidewalls 232 and 234 of respective fluid channels 130 and 230 and end walls 118 and 119 and 218 and 219 of respective fluid ejection chambers 110 and 210.

In one embodiment, barrier layers 150 and 250 each have a thickness defining a height H (see FIG. 2). As described above, barrier layers 150 and 250 may be formed of one or more layers of material. As such, the thickness of barrier layers 150 and 250 contributes to the height or depth of fluid ejection chambers 110 and 210, fluid restrictions 120 and 220, and fluid channels 130 and 230. Thus, by optimizing parameters of fluid ejection devices 100 and 200, the volume and/or rate of fluid supplied to fluid ejection chambers 110 and 210 can be optimized.

In one embodiment, the feed rate of fluid ejection chambers 110 and 210 is directly proportional to the cross-sectional area of respective fluid restrictions 120 and 220. Accordingly, the cross-sectional area of fluid restrictions 120 and 220 is defined by the height or depth of fluid restrictions 120 and 220 and the width of fluid restrictions 120 and 220. As such, in one embodiment, the cross-sectional area of fluid restrictions 120 and 220 is substantially rectangular in shape. The cross-sectional area of fluid restrictions 120 and 220, however, may be other shapes.

In one embodiment, the total impedance to flow through fluid restrictions 120 and 220 to respective fluid ejection chambers 110 and 210 is optimized so as to avoid overfilling of fluid ejection chambers 110 and 210. As such, fluid ejection devices 100 and 200 are optimized so as to maintain a substantially constant impedance to flow of fluid to respective fluid ejection chambers 110 and 210 over a desired operating range. In one exemplary embodiment, fluid ejection devices 100 and 200 are each optimized so as to maintain a substantially constant impedance to flow of fluid to respective fluid ejection chambers 110 and 210 over an operating range up to at least approximately 48 kilohertz.

In one embodiment, fluid restrictions 120 and 220 each have a fluid restriction parameter. In one embodiment, the fluid restriction parameter is defined by the following equation:

$$(2*W+2*H)*L/(H*W),$$

wherein W is the width of respective fluid restrictions 120 and 220, H is the height of respective fluid restrictions 120 and 220, and L is the length of respective fluid restrictions 120 and 220. As such, the fluid restriction parameter of fluid restrictions 120 and 220 is optimized to optimize operation or performance of respective fluid ejection devices 100 and 200.

In one embodiment, as outlined in the table of FIG. 7, the fluid restriction parameter is optimized to be in a range of 1.5 to 5.75. As such, in one exemplary embodiment, with the thickness of orifice layers 160 and 260 selected to be 20 microns+/−1 micron and the thickness of barrier layers 150 and 250 and, therefore, height H of respective fluid restrictions 120 and 220 selected to be approximately 17 microns, width W and length L of fluid restrictions 120 and 220 are selected to optimize the fluid restriction parameter.

In another embodiment, as outlined in the table of FIG. 8, the fluid restriction parameter is optimized to be in a range of 1.5 to 4.5. As such, in one exemplary embodiment, with the thickness of orifice layers 160 and 260 selected to be 14 microns+/−1 micron and the thickness of barrier layers 150 and 250 and, therefore, height H of respective fluid restrictions 120 and 220 selected to be approximately 14 microns, width W and length L of fluid restrictions 120 and 220 are selected to optimize the fluid restriction parameter. In another exemplary embodiment, with the thickness of orifice layers 160 and 260 selected to be 14 microns+/−1 micron and the thickness of barrier layers 150 and 250 and, therefore, height H of respective fluid restrictions 120 and 220 selected to be approximately 17 microns, width W and length L of fluid restrictions 120 and 220 are selected to optimize the fluid restriction parameter.

Accordingly, as noted with the above examples, the thickness of barrier layers 150 and 250 and, therefore, height H of respective fluid restrictions 120 and 220, as well as width W and length L of fluid restrictions 120 and 220 are selected to optimize the fluid restriction parameter. Various combinations of height H, width W, and length L of fluid restrictions 120 and 220, therefore, may be selected to optimize the fluid restriction parameter.

In one embodiment, in addition to optimizing parameters of fluid ejection devices 100 and 200, as described above, properties of fluid ejected from fluid ejection devices 100 and 200 are also optimized to optimize performance of fluid ejection devices 100 and 200. For example, properties of fluid ejected from fluid ejection devices 100 and 200 are optimized to optimize drop weight and drop velocity of droplets ejected from fluid ejection devices 100 and 200, as well as optimize a high frequency response of fluid ejection devices 100 and 200.

In one embodiment, for example, surface tension and/or viscosity of fluid ejected from fluid ejection devices 100 and 200 is optimized to optimize performance of fluid ejection devices 100 and 200. In one exemplary embodiment, surface tension of the fluid ejected from fluid ejection devices 100 and 200 is in a range of approximately 21 dynes/centimeter to approximately 35 dynes/centimeter, and viscosity of the fluid ejected from fluid ejection devices 100 and 200 is in a range of approximately 1.5 centipoises to approximately 4.0 centipoises.

In one embodiment, fluid ejection devices 100 and 200 are optimized to produce droplets of substantially uniform or constant drop weight. In one exemplary embodiment, a drop weight of droplets ejected from fluid ejection devices 100 and 200 is in a range of approximately 3.5 nanograms to approximately 10.5 nanograms. In addition, in one embodiment, a frequency at which droplets of fluid are ejected from fluid ejection devices 100 and 200 is also optimized to optimize performance of fluid ejection devices 100 and 200.

In one embodiment, as described above, fluid ejection device 100 is tuned to optimize performance with one fluid (or ink), such as a black ink, and fluid ejection device 200 is tuned to optimize performance with another fluid (or ink), such as a colored ink. Parameters of fluid ejection devices 100 and 200, such as width W and length L of respective fluid restrictions 120 and 220, therefore, are selected to optimize the respective performance. Parameters of fluid ejection devices 100 and 200, however, remain within the overall system ranges. Accordingly, fluid ejection devices 100 and 200 may accommodate one or more different inks while being designed within the same system parameters.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection device, comprising:

a fluid chamber;

a fluid restriction communicated with the fluid chamber;

a fluid channel communicated with the fluid restriction; and a fluid feed slot communicated with the fluid channel, wherein a distance from an edge of the fluid feed slot to a center of the fluid chamber is in a range of approximately 45 microns to approximately 58 microns, wherein the fluid restriction has a fluid restriction parameter defined as (2*W+2*H)*L/(H*W), wherein W is a width of the fluid restriction, H is a height of the fluid restriction, and L is a length of the fluid restriction, and wherein the fluid restriction parameter is in a range of 1.5 to 5.75.

2. The fluid ejection device of claim 1, wherein the width of the fluid restriction is substantially constant between the fluid channel and the fluid chamber.

3. The fluid ejection device of claim 1, further comprising:

a resistor formed within the fluid chamber, wherein the resistor has an area in a range of approximately 200 square microns to approximately 625 square microns.

4. The fluid ejection device of claim 1, further comprising:

an orifice communicated with the fluid chamber, wherein the orifice has a diameter in a range of approximately 12 microns to approximately 18.5 microns.

5. The fluid ejection device of claim 1, further comprising:

an orifice communicated with the fluid chamber, wherein a contour of the fluid chamber follows a profile of the orifice.

6. The fluid ejection device of claim 5, wherein the contour of the fluid chamber includes an arcuate portion having a radius of curvature greater than a radius of the orifice.

7. A fluid ejection device, comprising:

a substrate having a fluid feed slot formed therein;

a barrier layer formed on the substrate, wherein the barrier layer defines a fluid chamber, a fluid restriction communicated with the fluid chamber, and a fluid channel communicated with the fluid feed slot of the substrate and the fluid restriction; and an orifice layer provided over the barrier layer and having an orifice formed therein communicated with the fluid chamber, wherein the orifice layer has a thickness of approximately 14 microns, and the barrier layer has a thickness of approximately 14 microns, wherein the fluid restriction has a fluid restriction parameter defined as (2*W+2*H)*L/(H*W), wherein W is a width of the fluid restriction, H is a height of the fluid restriction, and L is a length of the fluid restriction, and wherein the fluid restriction parameter is in a range of 1.5 to 5.75.

8. The fluid ejection device of claim 7, wherein the width of the fluid restriction is substantially constant between the fluid channel and the fluid chamber.

9. The fluid ejection device of claim 7, further comprising:

a resistor formed on the substrate and communicated with the fluid chamber, wherein the resistor has an area in a range of approximately 200 square microns to approximately 625 square microns.

10. The fluid ejection device of claim 7, wherein the orifice has a diameter in a range of approximately 12 microns to approximately 18.5 microns.

11. The fluid ejection device of claim 7, wherein a contour of the fluid chamber follows a profile of the orifice.

12. The fluid ejection device of claim 7, further comprising:

a supply of fluid communicated with the fluid channel, wherein the fluid has a surface tension in a range of approximately 21 dynes per centimeter to approximately 35 dynes per centimeter, and a viscosity in a range of approximately 1.5 centipoises to approximately 4.0 centipoises.

13. The fluid ejection device of claim 12, wherein the fluid ejection device is adapted to eject drops of the fluid at a frequency up to at least approximately 48 kilohertz with each of the drops having a weight in a range of approximately 4 nanograms to approximately 9 nanograms.

14. A fluid ejection device, comprising:

a substrate having a fluid feed slot formed therein;

a barrier layer formed on the substrate, wherein the barrier layer defines a fluid chamber, a fluid restriction communicated with the fluid chamber, and a fluid channel communicated with the fluid feed slot of the substrate and the fluid restriction; and an orifice layer provided over the barrier layer and having an orifice formed therein communicated with the fluid chamber, wherein the orifice layer has a thickness of approximately 20 microns, and the barrier layer has a thickness of approximately 17 microns, wherein the fluid restriction has a fluid restriction parameter defined as (2*W+2*H)*L/(H*W), wherein W is a width of the fluid restriction, H is a height of the fluid restriction, and L is a length of the fluid restriction, and wherein the fluid restriction parameter is in a range of 1.5 to 5.75.

15. The fluid ejection device of claim 14, wherein the width of the fluid restriction is substantially constant between the fluid channel and the fluid chamber.

16. The fluid ejection device of claim 14, further comprising:

a resistor formed on the substrate and communicated with the fluid chamber, wherein the resistor has an area in a range of approximately 200 square microns to approximately 625 square microns.

17. The fluid ejection device of claim 14, wherein the orifice has a diameter in a range of approximately 12 microns to approximately 18.5 microns.

18. The fluid ejection device of claim 14, wherein a contour of the fluid chamber follows a profile of the orifice.

19. The fluid ejection device of claim 14, further comprising:

a supply of fluid communicated with the fluid channel, wherein the fluid has a surface tension in a range of approximately 21 dynes per centimeter to approximately 35 dynes per centimeter, and a viscosity in a range of approximately 1.5 centipoises to approximately 4.0 centipoises.

20. The fluid ejection device of claim 19, wherein the fluid ejection device is adapted to eject drops of the fluid at a frequency up to at least approximately 48 kilohertz with each of the drops having a weight in a range of approximately 4 nanograms to approximately 9 nanograms.

* * * * *

UNITED STATES PATENT AND TRADEMARK OFFICE

CERTIFICATE OF CORRECTION

PATENT NO. : 7,517,056 B2
APPLICATION NO. : 11/352678
DATED : April 14, 2009
INVENTOR(S) : Elizabeth A. Fellner et al.

It is certified that error appears in the above-identified patent and that said Letters Patent is hereby corrected as shown below:

In column 2, line 62, before "through" insert --12--, therefor.

Signed and Sealed this

Fifteenth Day of September, 2009

David J. Kappos

David J. Kappos
*Director of the United States Patent and Trademark Office*